US011480194B2

(12) United States Patent
Oh et al.

(10) Patent No.: US 11,480,194 B2
(45) Date of Patent: Oct. 25, 2022

(54) TURBO COMPRESSOR

(71) Applicant: LG ELECTRONICS INC., Seoul (KR)

(72) Inventors: Jun Chul Oh, Seoul (KR); Kyungmin Kim, Seoul (KR); Seheon Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/055,289

(22) PCT Filed: Apr. 24, 2019

(86) PCT No.: PCT/KR2019/004955
§ 371 (c)(1),
(2) Date: Nov. 13, 2020

(87) PCT Pub. No.: WO2019/221417
PCT Pub. Date: Nov. 21, 2019

(65) Prior Publication Data

US 2021/0172458 A1 Jun. 10, 2021

(30) Foreign Application Priority Data

May 15, 2018 (KR) ..... 10-2018-0055675
May 15, 2018 (KR) ..... 10-2018-0055676

(51) Int. Cl.
*F04D 29/053* (2006.01)
*F04D 29/051* (2006.01)
(Continued)

(52) U.S. Cl.
CPC ..... *F04D 29/582* (2013.01); *F04D 17/10* (2013.01); *F04D 29/053* (2013.01); *F04D 29/054* (2013.01); *F04D 29/0513* (2013.01)

(58) Field of Classification Search
CPC .. F04D 29/051; F04D 29/0513; F04D 29/054; F04D 29/20; F04D 29/26; F04D 17/122; F04D 29/057; F04D 29/624
See application file for complete search history.

(56) References Cited

U.S. PATENT DOCUMENTS 6,368,077 B1 4/2002 Meyerkord et al.
6,997,686 B2 * 2/2006 Agrawal ..... F04D 25/0606 417/370
(Continued)

FOREIGN PATENT DOCUMENTS

CN 102213222 10/2011
CN 103650226 3/2014
(Continued)

OTHER PUBLICATIONS

International Search Report (with English Translation) dated Aug. 2, 2019 issued in Application No. PCT/KR2019/004955.
(Continued)

*Primary Examiner* — Justin D Seabe
(74) *Attorney, Agent, or Firm* — Ked & Associates

(57) ABSTRACT

A turbo compressor comprises a rotary shaft including a rotor; a first impeller coupled to one side of the rotary shaft, a thrust bearing runner coupled between the first impeller and the rotary shaft, an impeller sleeve compressed and coupled between the first impeller and the thrust bearing runner, a second impeller coupled to the other side of the rotary shaft, and a tie rod passing through the first impeller and a thrust bearing and fastened to the rotary shaft.

16 Claims, 15 Drawing Sheets

(51) Int. Cl.

| | |
|---|---|
| ***F04D 29/58*** | (2006.01) |
| ***F04D 17/10*** | (2006.01) |
| ***F04D 29/054*** | (2006.01) |

(56) References Cited

U.S. PATENT DOCUMENTS

| | | | | |
|---|---|---|---|---|
| 8,925,197 | B2 * | 1/2015 | Royal | F04D 29/058<br>29/888.024 |
| 10,677,257 | B2 * | 6/2020 | Armand | F16D 1/072 |
| 2004/0005228 | A1 | 1/2004 | Agrawal et al. | |
| 2011/0239695 | A1 * | 10/2011 | Sugitani | F04D 29/266<br>415/131 |
| 2013/0230382 | A1 | 9/2013 | De Larminat et al. | |

FOREIGN PATENT DOCUMENTS

| | | |
|---|---|---|
| CN | 104334887 | 2/2015 |
| CN | 105889096 | 8/2016 |
| CN | 107002703 | 8/2017 |
| JP | 10-115295 | 5/1998 |
| JP | 11-13686 | 1/1999 |
| JP | 11-13696 | 1/1999 |
| JP | 2009-530537 | 8/2009 |
| JP | 4474707 | 6/2010 |
| KR | 10-2001-0064028 | 7/2001 |
| KR | 10-2011-0091388 | 8/2011 |
| KR | 10-1699712 | 1/2017 |

OTHER PUBLICATIONS

Chinese Office Action issued in Application No. 201980032457.1 dated Apr. 29, 2022.

Chinese Office Action issued in Application No. 201980032457.1 dated Sep. 21, 2022.

* cited by examiner

TURBO COMPRESSOR

CROSS-REFERENCE TO RELATED PATENT APPLICATIONS

This application is a U.S. National Stage Application under 35 U.S.C. § 371 of PCT Application No. PCT/KR2019/004955, filed Apr. 24, 2019, which claims priority to Korean Patent Application Nos. 10-2018-0055675 and 10-2018-0055676, both filed May 15, 2018, whose entire disclosures are hereby incorporated by reference.

TECHNICAL FIELD

The present disclosure relates to a turbo compressor to improve rigidity of a rotary shaft, improve a coupling force between the rotary shaft and an impeller, and ensure reliability of a bearing.

BACKGROUND ART

Compressors include reciprocating compressors, screw compressors, and turbo compressors.

A reciprocating compressor compresses gas by a reciprocating motion of a piston in a cylinder and a screw compressor compresses gas based on rotation of a screw rotor including two shafts each having a pair of torsion threads, for example, an internal thread and an external thread.

The turbo compressor is an example of a centrifugal compressor and compresses gas based on a centrifugal force generated by rotating a wheel of a rear wing in a casing.

Turbo compressors have advantages of large capacity, low noise, and easy maintenance compared to reciprocating compressors and screw compressors.

In addition, the turbo compressors may produce clean compressed gas that does not contain oil.

Gas-compressing components of a centrifugal turbo compressor include an impeller to accelerate gas and a diffuser to decelerate the accelerated gas flow and convert into pressure energy.

When the motor rotates the impeller at a relatively high speed, external gas is suctioned along an axial direction of the impeller, and the suctioned gas is discharged in a centrifugal direction of the impeller.

An important factor in the design of the turbo compressor is a first bending mode of the rotary shaft.

A design to ensure the rigidity of the rotary shaft is important to avoid a critical speed of the rotary shaft in the first bending mode thereof.

FIG. 1 shows a cross section of a turbo compressor in related art. FIG. 2 shows a rotary shaft of a turbo compressor in related art.

Referring to FIGS. 1 and 2, the turbo compressor in the related art includes a casing 10, a stator 12 provided in the casing 10, and a rotary shaft 20 including a rotor 22 rotating inside the stator 12 and having both ends coupled to an impeller.

The rotary shaft 20 includes a thrust bearing runner 25 to support load in an axial direction.

An outer diameter of the rotary shaft 20 may be designed to be equal to or less than a predetermined level in consideration of an index of critical speed of a thrust bearing, and all components have to be firmly coupled with a greater force to operate in a high-temperature environment.

In a high-temperature environment, the rotary shaft 20 expands due to heat. If the coupling between the impeller and the rotary shaft 20 becomes loose due to the expansion, the impeller may not rotate with the rotary shaft 20 and slip may occur, thereby greatly degrading durability and reliability of the turbo compressor.

In order to resolve the above problem, U.S. Patent Publication No. 2004-0005228 (published on Jan. 8, 2004) discloses a structure using a tie bolt for coupling force.

FIG. 3 is a cross-sectional view showing a turbo compressor of related art FIG. 4 shows a cooling ring of a turbo compressor of related art.

As shown, a tie rod 48 passes through a center of the rotary shaft to couple components of the rotary shaft.

Both ends of a permanent magnet 52 of a rotor 42 are pressed by end caps 56 and 58, an outer circumferential surface of the permanent magnet 52 is inserted into a pressing sleeve 54, a first journal bearing shaft 40 is provided at the end cap 56, a second journal bearing shaft 44 is provided at the end cap 58, an impeller 20 is provided at the first journal bearing shaft 40, a thrust bearing 46 is provided at the second journal bearing shaft 44, and the tie rod 48 passes through and couples the above components.

This structure has an advantage of strengthening a coupling force of the axial coupling components when a tensile force is applied to the tie rod 48, but has a disadvantage in that, as the turbo compressor includes many components, and the components are coupled by the tie rod 48 passing through centers thereof, the components thereof may be coupled with eccentricity with respect to the center of the rotary shaft.

The components each include through-holes. The tie rod 48 is coupled to the through-holes, passes through and is coupled to the components thereof.

In addition, a gap may exist between an outer diameter of the tie rod 48 and an inner diameter of the through-hole to couple the tie rod 48. In this case, due to the gap, the components coupled to the tie rod 48 may not be accurately aligned with respect to the center of the rotary shaft and may be coupled in an eccentric state.

When the eccentricity occurs, rotational moment of inertia increases, thereby degrading efficiency of the compressor.

The turbo compressor of the related art includes a housing 12 having a symmetric shape with respect to a central axis 14, an inlet 16 to introduce compressing fluid, a compressor including an impeller 20 and a diffuser 22, a motor provided in the housing 12 and including a rotor 42 and a stator 50, and a cooling ring 36 provided in the housing 12 and to surround the stator 50.

The cooling ring 36 defines a spiral groove 38 (FIG. 4) on an outer circumferential surface thereof, an inlet 32, and a discharge outlet 34 to supply and recover cooling fluid between the housing 12 and the cooling ring 36.

The turbo compressor rotates at a high speed to generate heat. If the heat generated during the operation of the turbo compressor is not properly cooled, friction-generating portions and the drive motor may be damaged.

In addition, the turbo compressor of the related art includes the cooling ring 36 provided inside the housing 12 and supplies the cooling fluid between the cooling ring 36 and the housing 12 (e.g., through a groove 38 defined on the outer circumferential surface of the cooling ring).

This structure cools the housing 12 and the cooling ring 36 of the turbo compressor to effectively cool the motor and indirectly cool a bearing friction portion.

Therefore, when the rotational speed of the turbo compressor is increased, the bearing has to be cooled. However, the structure in the related art has a problem in that the structure does not effectively cool the bearing.

DISCLOSURE

Technical Problem

The present disclosure is to solve the above-described problems and provides a turbo compressor capable of avoiding a first bending mode of a rotary shaft even during high-speed rotation by obtaining rigidity of the rotary shaft of the turbo compressor.

The present disclosure also provides a turbo compressor in which components coupled to the rotary shaft may be accurately aligned with respect to a center of the rotary shaft.

The present disclosure further provides a turbo compressor capable of maintaining a rigidly fixed state of components such as an impeller even in a high-temperature environment in which the turbo compressor is operated at a high speed.

The present disclosure further provides a turbo compressor suitable for miniaturization.

The present disclosure further provides a turbo compressor including a cooling flow path to supply fluid to a thrust bearing runner to stably operate at a high speed.

The present disclosure further provides a turbo compressor capable of supplying a portion of refrigerant discharged through a discharge flow path to an inside of a bearing casing to cool a thrust bearing.

The present disclosure further provides a turbo compressor capable of supplying a portion of refrigerant inside an impeller casing to the inside of the bearing casing and to cool the thrust bearing.

Technical Solution

In order to achieve the above object, a turbo compressor according to an embodiment of the present disclosure is a back-to-back type, two-stage turbo compressor in which rear surfaces of two impellers face eachother and are coupled with a preload applied.

In addition, a thrust bearing runner is provided at a rear surface of the first impeller having a relatively large diameter, and the thrust bearing runner and the first impeller are coupled using the tie rod in a state in which the preload is applied, thereby obtaining a coupling force between the thrust bearing runner and the first impeller.

In addition, a coupling shaft portion of each of the first impeller and the thrust bearing runner are inserted into an impeller sleeve or coupling sleeve provided between the first impeller and the thrust bearing runner to provide the coupling force between the first impeller and the thrust bearing runner by stationary fit between the impeller sleeve and the coupling shaft portion.

In addition, the rotary shaft includes a multistage structure in which diameters are reduced at an end of the rotary shaft coupled to the second impeller to increase a contact area between the second impeller and the rotary shaft on which the coupling force is applied.

In addition, the turbo compressor may compress refrigerant supplied to the impeller by rotating the impeller based on an operation of a drive motor and cool the inside of the turbo compressor using the refrigerant discharged from the impeller.

In addition, the turbo compressor may include a cooling flow path branched from the discharge flow path to guide the refrigerant discharged from the impeller and connected to an inside of the bearing casing to accommodate the thrust bearing runner.

In addition, the turbo compressor may include a recovery flow path to return the refrigerant supplied to the inside of the bearing casing to the impeller.

In addition, a flow rate control valve may be provided in at least one of the cooling flow path or the recovery flow path to adjust a flow rate of the refrigerant supplied into the bearing casing.

In addition, the turbo compressor may include a heat exchanger on the cooling flow path to exchange heat between refrigerant in the cooling flow path and refrigerant suctioned through the suction flow path, thereby reducing a temperature of the refrigerant supplied through the cooling flow path.

Advantageous Effects

According to the present disclosure, for a turbo compressor, a first impeller and a thrust bearing runner are coupled using a tie rod in a state in which a preload is applied, and a second impeller is coupled to a multistage rotary shaft by applying the preload to a small diameter portion of the rotary shaft. There is an advantage in that a coupling force between rotating components of the turbo compressor rotating at a high speed is obtained.

In addition, there is an advantage in that rigidity of the rotary shaft may be easily obtained, and relatively higher operating frequency may be obtained.

In addition, there is an advantage in that an insufficiency of the coupling force of the impeller may be resolved using a tie bolt.

In addition, there is an advantage in that the turbo compressor may efficiently cool a heat generating portion during an operation of the turbo compressor.

In addition, the heat generated during the operation of the turbo compressor may be cooled using fluid supplied to and compressed by the impeller, not using additional refrigerant, thereby simplifying a cooling structure of the turbo compressor.

In addition, there is an advantage in that the turbo compressor directly supplies the fluid to the heat generating portion to effectively control the temperature of the heat generating portion.

In addition, there is an advantage in that the turbo compressor exchanges heat between the cooling fluid and the fluid introduced into the impeller to reduce the temperature of the cooling fluid and reduce a flow rate of the supplied fluid.

BEST MODE

Figure 1:
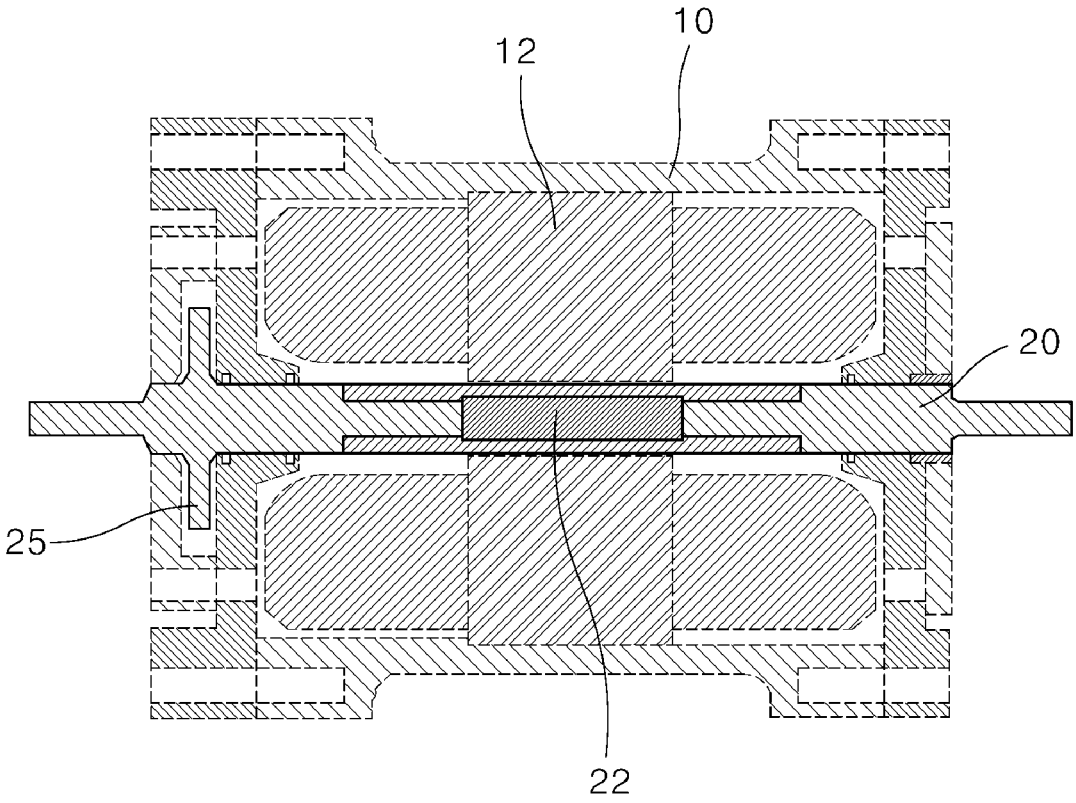
FIG. 1 shows a cross section of a turbo compressor according to related art.

Hereinafter, example embodiments of the present disclosure will be described in detail with reference to the accompanying drawings. Reference now should be made to the drawings, in which the same reference numerals are used throughout the different drawings to designate the same or similar components. A detailed description of a well-known configuration or function relating to the present disclosure may be omitted if it unnecessarily obscures the gist of the present disclosure.

In some examples, terms such as first, second, A, B, (a), (b) and the like may be used herein when describing elements of the present disclosure. These terms are intended to distinguish one element from other elements, and the essence, order, or sequence of corresponding elements are not limited by these terms. It should be noted that if it is described in the present disclosure that one component is "connected," "coupled" or "joined" to another component, the former may be directly "connected," "coupled" or "joined" to the latter or "connected," "coupled" or "joined" to the latter via another component.

A turbo compressor is an example of a centrifugal compressor and compresses gas based on a centrifugal force generated by rotating an impeller in a casing.

The turbo compressor suctions gas in an axial direction using a rotational force of the impeller and then discharges the gas in a centrifugal direction to perform a compression operation. A two-stage compression turbo compressor has been used as an example of the turbo compressor.

A number of stages of the turbo compressor may be determined based on a number of impellers, and the turbo compressor may be classified into a back-to-back type turbo compressor or a face-to-face type turbo compressor according to an arrangement of impellers.

In the back-to-back type turbo compressor, rear or base surfaces of the impellers face each other. In the face-to-face type turbo compressor, suction ends of the impellers face each other.

The turbo compressor according to an embodiment of the present disclosure described below is a two-stage, back-to-back type turbo compressor including two impellers having rear surfaces facing each other.

Figure 5:
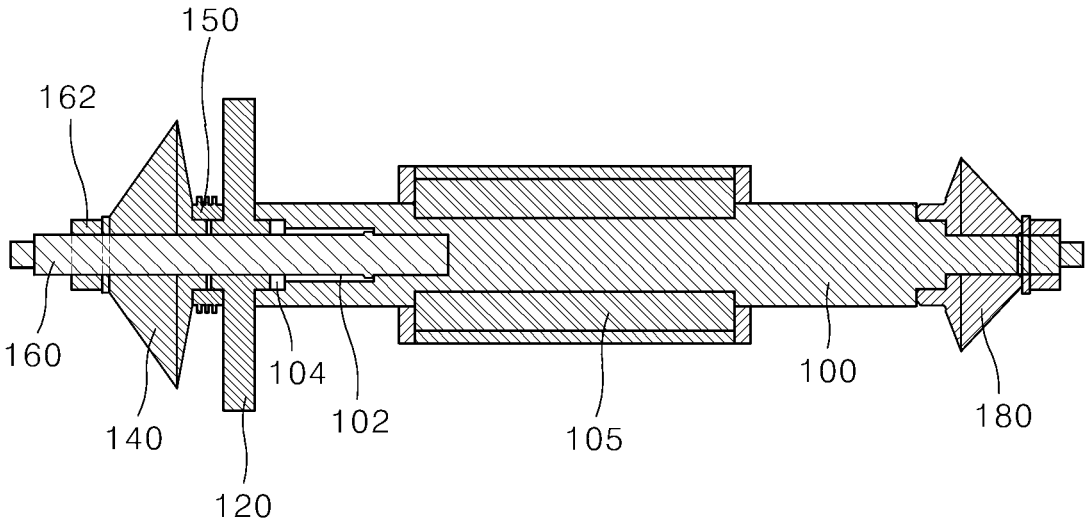
FIG. 5 shows a rotary shaft of a turbo compressor according to a first embodiment of the present disclosure.

FIG. 5 shows a rotary shaft of a turbo compressor according to a first embodiment of the present disclosure.

Figure 6:
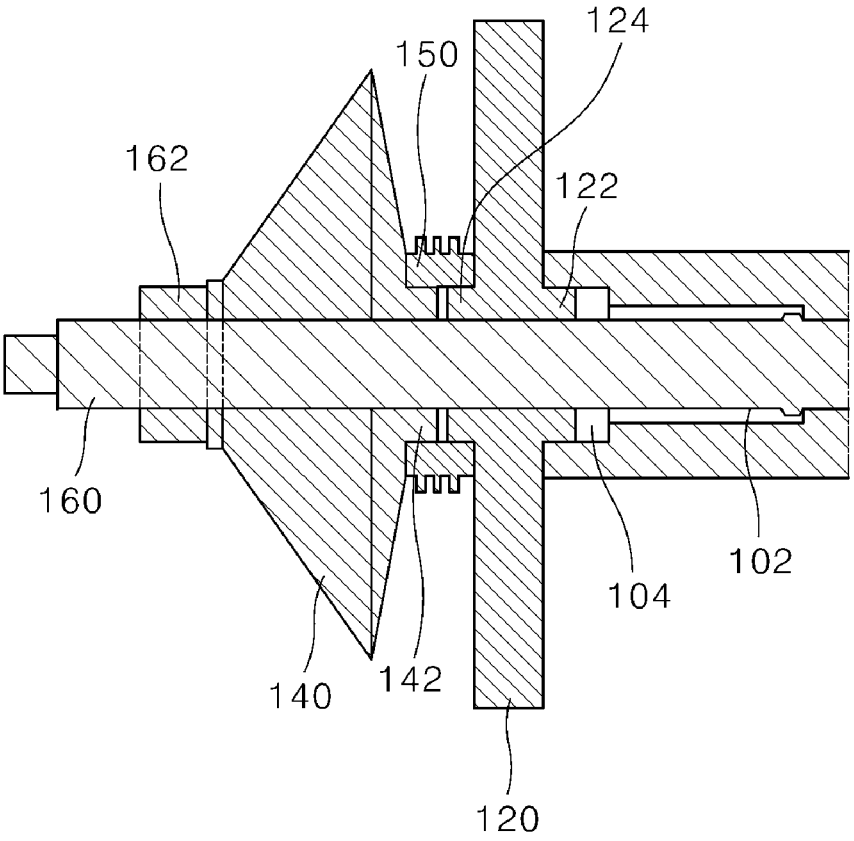
FIG. 6 is an enlarged view showing a coupling portion between a rotary shaft of a turbo compressor and a thrust bearing runner according to a first embodiment of the present disclosure.

FIG. 6 is an enlarged view showing a coupling portion between a rotary shaft of a turbo compressor and a thrust bearing runner according to a first embodiment of the present disclosure.

An important factor for miniaturizing the turbo compressor is a first bending mode of the rotary shaft. The rotary shaft rotates at a high speed and is operated under high-pressure conditions, and if the rotary shaft is in the first bending mode within a range of operating speed, reliability of operation may not be obtained.

In order for the rotary shaft to be suitable for high-speed operation, the rotary shaft may have a relatively short length and a relatively larger diameter to facilitate rigidity. However, there is a limitation in that there is difficulty in increasing a diameter of the shaft because a Diameter Nominal (DN) number, which is a design limit of the bearing, has to be considered with respect to the diameter of the shaft.

The present disclosure provides a structure of the turbo compressor to obtain a force that couples two impellers and the thrust bearing runner to the rotary shaft.

Referring to FIGS. 5 and 6, the turbo compressor according to a first embodiment of the present disclosure includes a rotary shaft 100 having a rotor 105, a thrust bearing runner 120 provided at one side of the rotary shaft 100, a first impeller 140 provided outside the thrust bearing runner 120, a tie rod 160 to couple the first impeller 140 and the thrust bearing runner 120 to the rotary shaft 100 by applying a preload to the tie rod 160, and a second impeller 180 coupled to the other side of the rotary shaft 100.

The second impeller 180 may have an outer diameter that is relatively smaller than that of the first impeller 140.

In other words, the thrust bearing runner 120 may be close to the impeller having the relatively large diameter (i.e., the first impeller 140).

As the diameter of the first impeller 140 increases, axial load applied to the rear surface of the first impeller 140 increases. The thrust bearing runner 120 is provided at the rear or base surface of the first impeller 140 having the relatively large diameter to effectively support the rotation of the first impeller 140.

The rear surface of the first impeller 140 may mean a right surface in FIG. 5, or a surface at an end of the first impeller 140 having a base plate or a surface at an end of the first impeller 140 having a diameter greater than a remaining portion of the first impeller 140. As embodiments disclosed herein provide a back-to-back turbo compressor in which rear surfaces of impellers face each other, the rear surface of the second impeller 180 may mean a left surface in FIG. 5, or a surface facing the rear surface of the first impeller 140. If a front-rear direction of the turbo compressor is defined as a direction from the first impeller 140 to the second impeller 180, the "rear surface" of the second impeller 180 may be in front of a surface of the second impeller 180 opposite to the rear surface.

In addition, the rotor 105 may protrude from other portions of the rotary shaft 110.

The rotor 105 includes a permanent magnet and easily performs a high-speed rotation as a size of the permanent magnet is increased.

Therefore, an outer diameter of the rotor 105 is increased to obtain a rotational force of a drive motor.

As described above, when the diameter of the rotary shaft 100 is increased, the rotary shaft 100 has a disadvantage in terms of DN number, which is a limitation of a journal bearing supporting the rotary shaft 100.

The DN number is calculated as a product of a diameter of the rotary shaft 100 and a number of rotations thereof. As the diameter of the rotary shaft 100 is increased, the DN number is increased.

Accordingly, according to the present disclosure, both side portions of the rotary shaft 100 have diameters that are each smaller than the diameter of the rotor 105, thereby improving stability in high-speed rotation.

According to the present disclosure, the turbo compressor couples the thrust bearing runner 120 and the first impeller 140 using the tie rod 160 in a state in which pre load is applied, thereby obtaining the coupling force between the thrust bearing runner 120 and the first impeller 140.

When the turbo compressor rotates, the first impeller 140 receives a load in a leftward or forward direction in FIG. 5 based on a pressure difference generated by the rotation.

To compensate for the load, the preload is applied to the tie rod 160 to couple the first impeller 140 and the thrust bearing runner 120 to the rotary shaft 100.

The rotary shaft 100 includes a hollow groove 102 for coupling the tie rod 160 to the rotary shaft 100 by applying the pre load to the tie rod 160, and the hollow groove 102 has an inner diameter that is larger than an outer diameter of the tie rod 160.

The tie rod 160 has one end coupled through the hollow groove 102 and the other end coupled to a fastening nut 162.

In other words, when the fastening nut 162 is tightened while the thrust bearing runner 120 and the impeller 140 are inserted between a left end of the rotary shaft 100 and the fastening nut 162, the tie rod 160 is tensioned, and the impeller 140 and the thrust bearing runner 120 are compressed and coupled.

A magnitude of the preload applied to the tie rod 160 may be set by adjusting a degree of tightening of the fastening nut 162.

The hollow groove 102 is defined to allow the tie rod 160 to be in the tensioned state when the tie rod 160 is coupled and has an inner diameter that is larger than an outer diameter of the tie rod 160.

When a frictional force occurs between the tie rod 160 and the hollow groove 102, a portion of the preload applied to the tie rod 160 is canceled or countered by the frictional force between the tie rod 160 and an inner wall of the hollow groove 102. In this case, the preload applied to the tie rod 160 may not act as a fastening force.

An impeller sleeve 150 may be provided between the first impeller 140 and the thrust bearing runner 120 to achieve sealing performance of the first impeller 140.

The impeller sleeve 150 may have a concavo-convex shape to prevent fluid leakage between the first impeller 140 and the impeller housing. For example, the impeller sleeve 150 may be made of a labyrinth seal.

According to the present disclosure, the impeller sleeve 150 is provided between the first impeller 140 and the thrust bearing runner 120 to provide a coupling force for coupling the first impeller 140 and the thrust bearing runner 120.

As shown, the ends of the thrust bearing runner 120 and the first impeller 140 are inserted into the inner diameter of the impeller sleeve 150, and the impeller sleeve 150 surrounds an outer circumference of a connecting portion between the first impeller 140 and the thrust bearing runner 120 and couples the first impeller 140 and the thrust bearing runner 120.

For this coupling, a coupling shaft portion or shaft 142 is provided at a rear or right side of the first impeller 140, and a coupling shaft portion or shaft 124 is provided at a front or left side of the thrust bearing runner 120. The coupling shaft portion 142 and the coupling shaft portion 124 are inserted into the impeller sleeve 150.

In this case, an outer diameter of each of the coupling shafts 142, 124 is larger than the inner diameter of the impeller sleeve 150. When the coupling shaft portions 142, 124 are forcibly coupled to or fitted into the impeller sleeve 150, the impeller sleeve 150 may provide the coupling force to couple the first impeller 140 and the thrust bearing runner 120.

In this case, a sum of lengths of the coupling shaft portions 142 and 124 is smaller than a length of the impeller sleeve 150 such that there may be a gap or such that the coupling shaft portions 142 and 125 do not contact each other, and the pre load is applied to the first impeller 140 and the thrust bearing runner 120 by tightening the fastening nut 162 coupled to the tie rod 160, and thus, the impeller sleeve 150 is compressed and coupled between the first impeller 140 and the thrust bearing runner 120.

When the sum of the lengths of the coupling shaft portions 142 and 124 is equal to or larger than that of the impeller sleeve 150, the coupling shaft portions 142 and 124 contact each other to prevent the compression of the first impeller 140 and the thrust bearing runner 120 by the impeller sleeve 150.

In addition, the thrust bearing runner 120 coupled between the first impeller 140 and the rotary shaft 100 may also be coupled to the rotary shaft 100 by stationary fitting.

As shown, the rotary shaft 100 includes a coupling groove 104 at an end of the hollow groove 102, the coupling groove 104 has an inner diameter that is larger than the inner diameter of the hollow groove 102, and the thrust bearing runner 120 includes a coupling shaft 122. The coupling shaft 122 may be coupled to the coupling groove 104 by stationary fitting.

An outer diameter of the coupling shaft 122 is larger than the inner diameter of the coupling groove 104 to forcibly couple the coupling shaft 122 of the thrust bearing runner 120 to the coupling groove 104.

Therefore, a contact area between the rotary shaft 100 and the thrust bearing runner 120 provided between the first impeller 140 and the rotary shaft 100 may be obtained to provide a coupling force between the thrust bearing runner 120 and the rotary shaft 100.

The thrust bearing runner 120 inserted into the coupling groove 104 is shorter than a depth of the coupling groove 104 such that a compressive force is applied between the thrust bearing runner 120 and the left end of the rotary shaft 100 by the preload applied to the tie rod 160.

Figure 7:
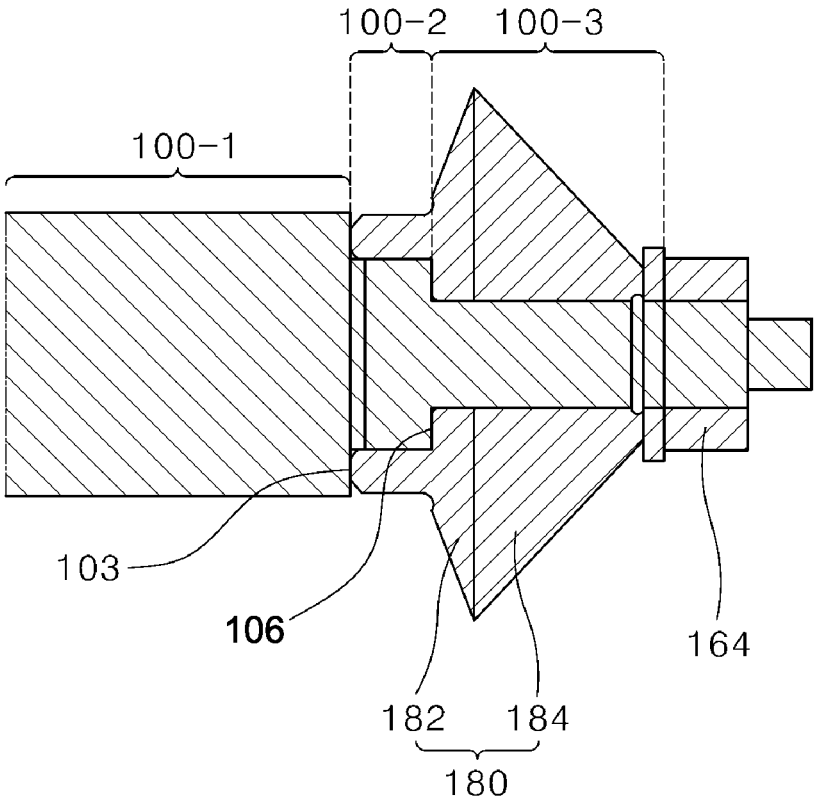
FIG. 7 is an enlarged view showing a coupling portion of a rotary shaft of a turbo compressor and a second impeller according to a first embodiment of the present disclosure.

FIG. 7 is an enlarged view showing a coupling portion between a rotary shaft and a second impeller of a turbo compressor according to a first embodiment of the present disclosure.

Referring to FIG. 7, the second impeller 180 has a diameter that is relatively smaller than that of the first impeller 140 and is coupled to the rotary shaft 100 with multiple stages for providing a coupling force to couple the second impeller 180 and the rotary shaft 100.

The second impeller 180 may be directly coupled to the rotary shaft 100 using a fastening bolt 164.

The end of the rotary shaft 100 coupled to the second impeller 180 has a multi-stage structure in which a diameter is reduced with two stages.

Hereinafter, a portion with a largest diameter of the rotary shaft 100 is referred to as a large-diameter or first portion 100-1, a portion with a smallest diameter of the rotary shaft 100 is referred to as a small-diameter or third portion 100-3, and a portion with a diameter that is smaller than the diameter of the large diameter portion 100-1 and larger than the diameter of the small-diameter portion 100-3 is referred to as a middle-diameter or second portion 100-2. The large-diameter, middle-diameter, and small-diameter portions 100-1, 100-2, and 100-3 may alternatively be referred to as first, second, and third sections.

The second impeller 180 is coupled to the middle-diameter portion 100-2 and the small-diameter portion 100-3.

The second impeller 180 includes a base plate 182 and an impeller blade 184 provided on the base plate 182.

A rotary shaft fastening hole of the second impeller 180 has a first inner diameter corresponding to the middle-diameter portion 100-2 on the base plate 182 and has a second inner diameter corresponding to the small-diameter portion 100-3 on the impeller blade 184.

This structure has an effect of increasing an effective area of the impeller blade 184 by reducing the inner diameter of the impeller blade 184.

In addition, a stronger coupling force to couple the rotary shaft 100 and the second impeller 180 may be set.

When the second impeller 180 is coupled to the rotary shaft 100 in multiple stages, a radial and/or circumferential surface of the rotary shaft 100 contacts the second impeller 180, and the contact area thereof is enlarged.

Accordingly, the coupling force to couple the second impeller 180 and the rotary shaft 100 may be increased.

An inner surface of the second impeller 180 is supported by a first stepped surface 103 between the large-diameter portion 100-1 and the middle-diameter portion 100-2 of the rotary shaft 100, and a stepped surface inside the base plate 182 of the second impeller 180 is supported by a second stepped surface 106 between the middle-diameter portion 100-2 and the small-diameter portion 100-3 of the rotary shaft 100.

This structure allows the coupling contact on which the frictional force acts to be expanded when the second impeller 180 is coupled to the rotary shaft 100 by stationary fitting or shrink-fitting.

In addition, when the fastening bolt 164 is coupled, the second impeller 180 is compressed between the first stepped surface 103 of the rotary shaft 100 and the fastening bolt 164, and the middle diameter portion 100-2 and the small diameter portion 100-3 of the rotary shaft 100 are tensioned.

The preload applied to the second impeller 180 at the middle diameter portion 100-2 and the small diameter portion 100-3 of the rotary shaft 100 may be adjusted by controlling the fastening force of the fastening bolt 164.

In this structure, the first impeller 140 and the second impeller 180 receiving the greatest force are symmetrical to each other in a forward and rearward direction (or leftward-rightward direction) and are equally deformed in the forward and rearward direction.

If the deformation is biased to one side, the reliability of the turbo compressor may be deteriorated due to the deformation during high-speed operation.

The tie rod 160 may be coupled to the rotary shaft 100 in a state in which the tension load is applied to the tie rod 160 based on the tightening force of the fastening nut 162.

In other words, the tie rod 160 may be coupled in the state in which the pre load is applied to the tie rod 160. Therefore, even if deformation occurs in the tie rod 160 due to a thermal expansion and the tensile force is reduced, the pre load applied to the tie rod 160 absorbs the deformation due to the thermal expansion, thereby enabling reliable coupling of the tie rod 160.

In order to reduce the size of the turbo compressor and perform the high-speed rotation, the first impeller 140 and the thrust bearing runner 120 are coupled using the tie rod 160 in the state in which the preload is applied and the second impeller 180 is coupled to the rotary shaft 100 by applying the pre load to the small diameter portion of the multistage rotary shaft 100. Therefore, the present disclosure has an effect of obtaining the coupling force between the rotating components of the turbo compressor rotating at the high speed.

A result of an experiment of rotating the rotary shaft having a length of 177 mm and an outer diameter of 125 mm at 200,000 rpm is as follows.

Figure 2:
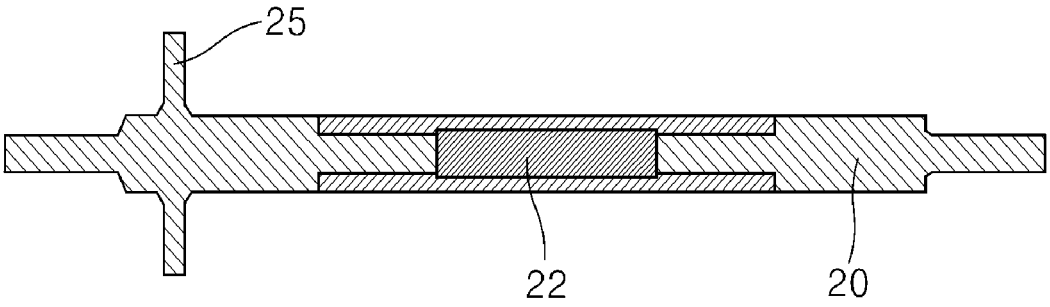
FIG. 2 shows a rotary shaft of a turbo compressor according to related art.
Figure 3:
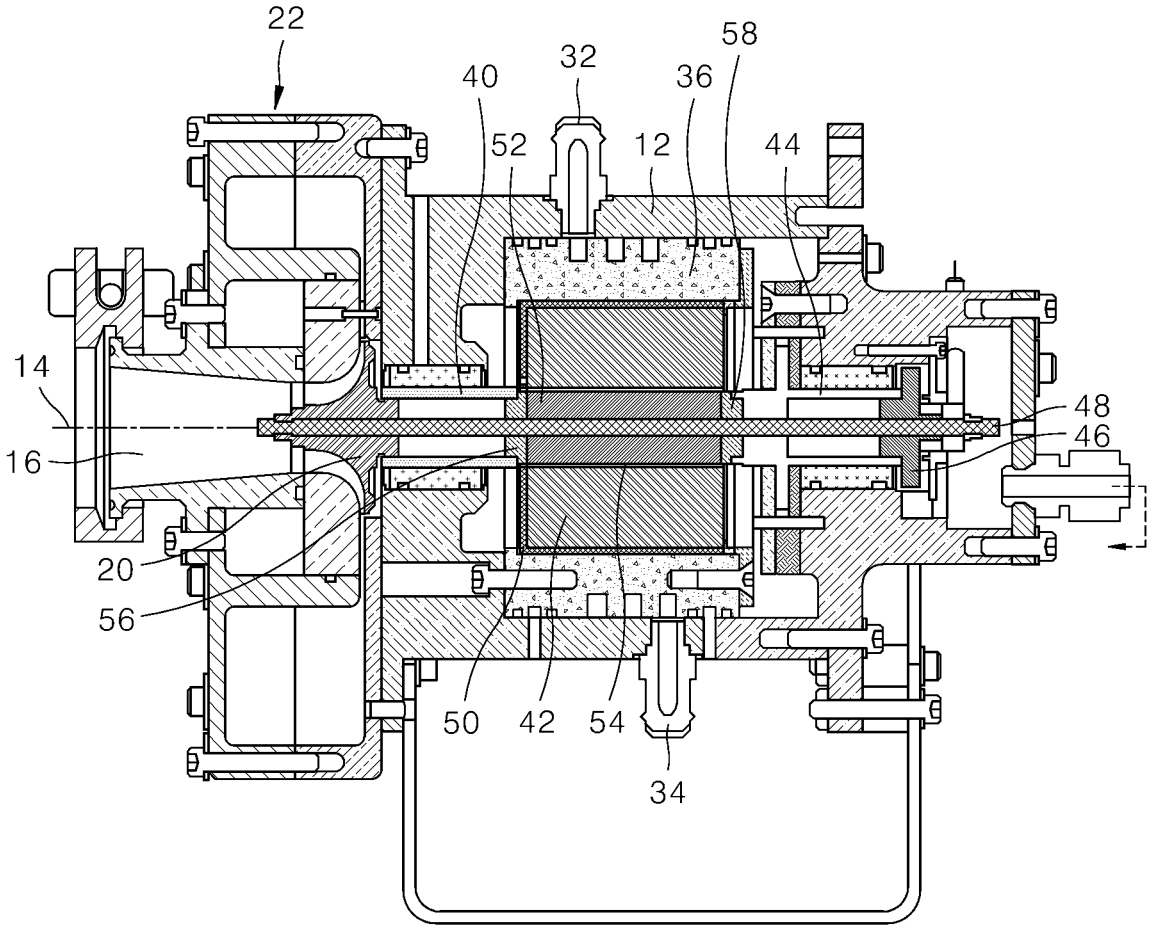
FIG. 3 shows a cross section of a turbo compressor the related art.
Figure 4:
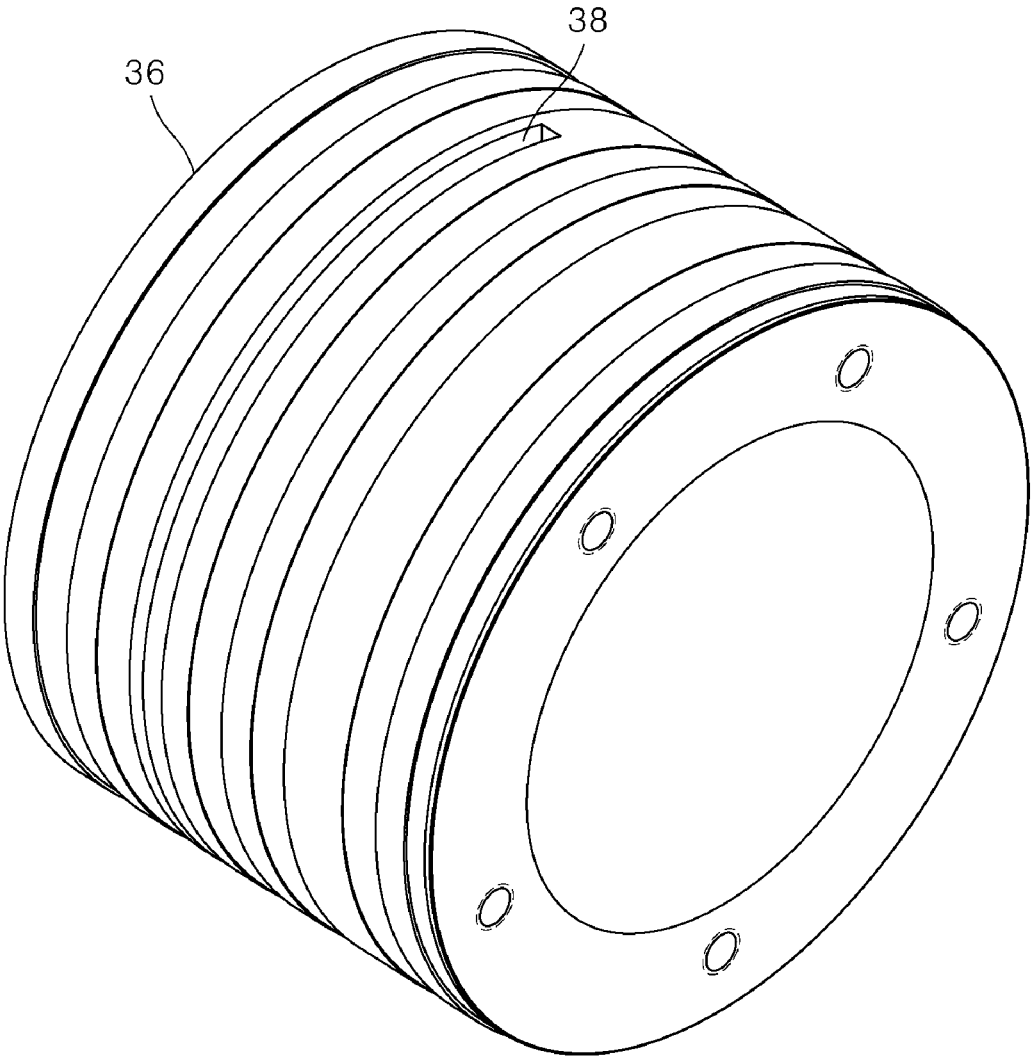
FIG. 4 shows a cooling ring of a turbo compressor the related art.

First bending frequency was 2,250.5 Hz and the DN Number was 2,500,000 mm×rpm. It was found that the first bending frequency was within a range of the operating speed, and thus, the turbo compressor shown in FIG. 2 was not suitable for high-speed operation.

A result of an experiment in which the rotary shaft shown in FIG. 5 having a length of 135.5 mm and an outer diameter of 14.5 mm of the turbo compressor of FIG. 5 according to the first embodiment of the present disclosure is rotated at 200,000 rpm is as follows.

First bending frequency was 5,1362.2 Hz and a DN Number was 2,900,000 mm×rpm. It was found that the first bending frequency was outside of an operating speed range, and thus, the rotary shaft 100 is suitable for the high-speed operation.

Figure 8:
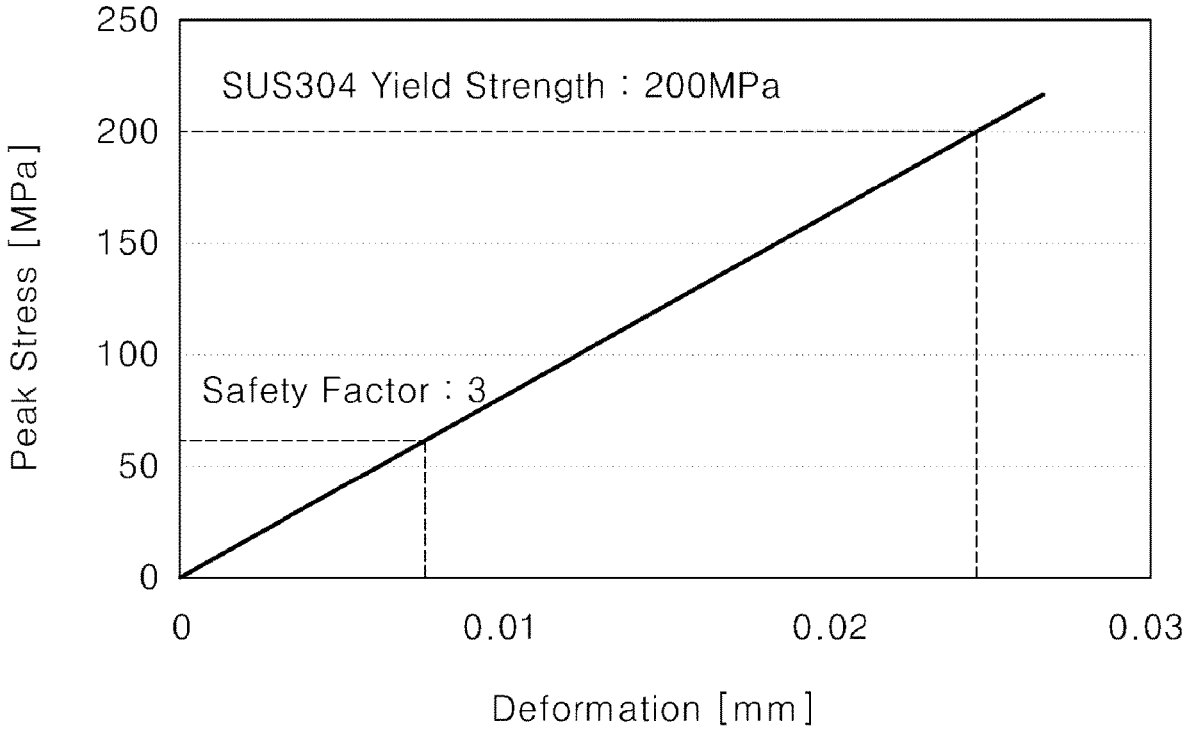
FIG. 8 is a graph showing deformation of stainless steel (SUS 304) material with respect to stress.
Figure 9:
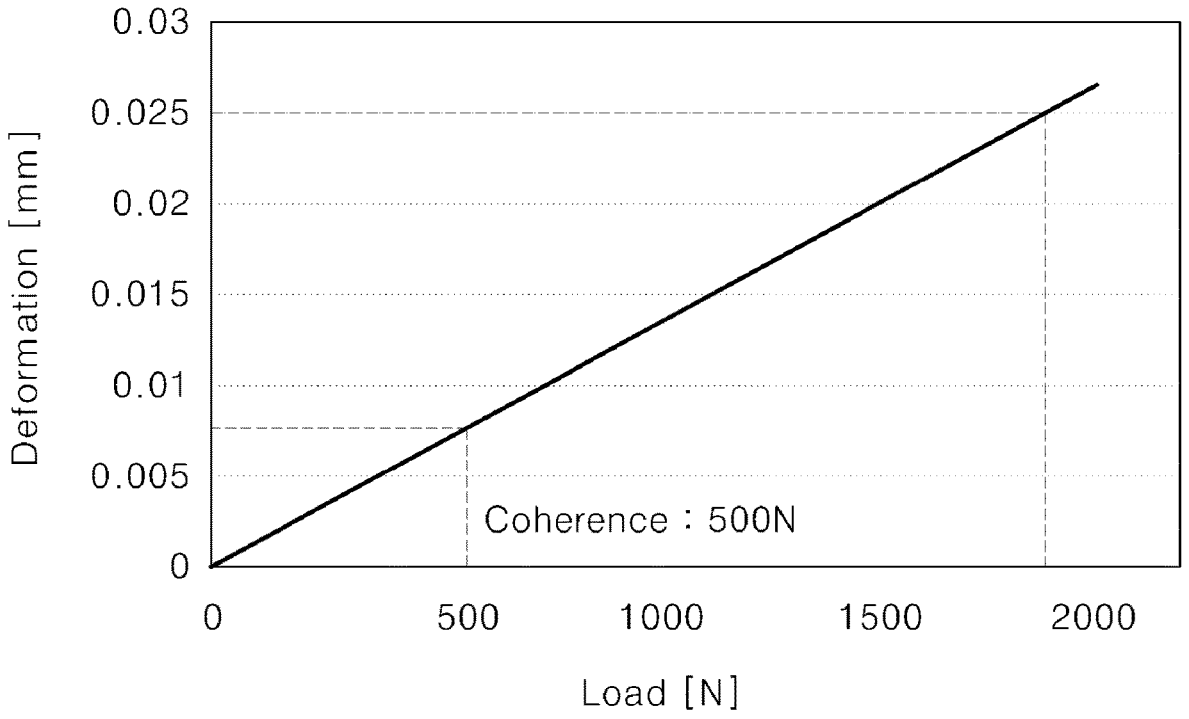
FIG. 9 is a graph showing relation between deformation and a coupling force of a tie bolt.

FIG. 8 is a graph showing deformation with respect to stress of a stainless steel (SUS 304) material. FIG. 9 is a graph showing relation between deformation and a coupling force of a tie rod.

Referring to FIGS. 8 and 9, the tie rod (e.g., tie rod 160 of FIG. 5) is made of, for example, a stainless steel (SUS 304) material. According to the graph showing the deformation of the SUS 304 material with respect to the stress, it can found that, if a safety factor is 3, the deformation may be less than 25 μm.

In addition, if the deformation of the tie rod is set in a range from 7 to 25 μm, preload of the rotary shaft 100 may be set to 500 to 1800 N.

Figure 10:
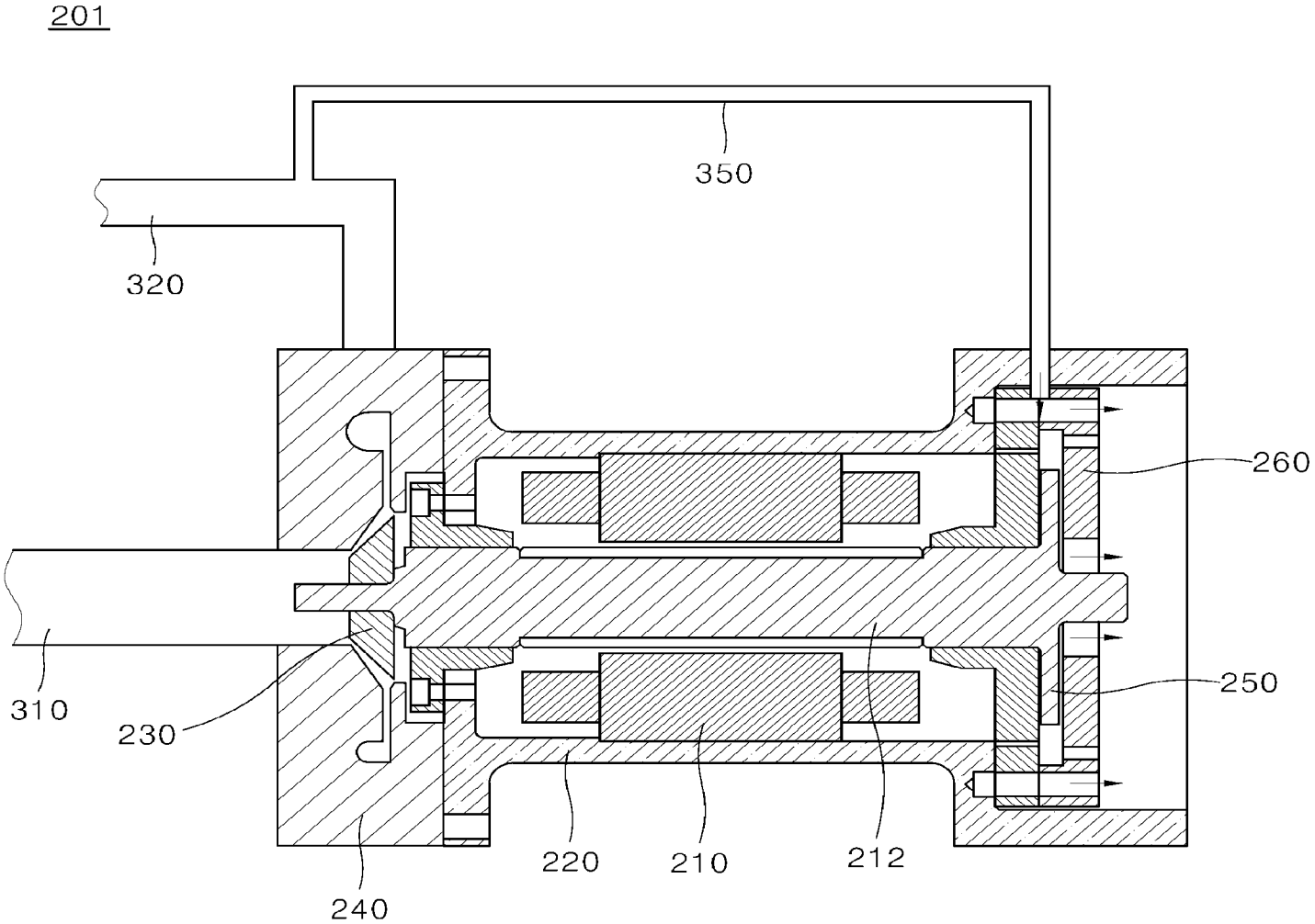
FIG. 10 is a configuration diagram showing a turbo compressor according to a second embodiment of the present disclosure.

FIG. 10 is a configuration diagram showing a structure of a turbo compressor according to a second embodiment of the present disclosure.

Referring to FIG. 10, a turbo compressor 201 according to a second embodiment of the present disclosure includes a drive motor 210 including a rotary shaft 212, an impeller 230 coupled to the rotary shaft 212, a thrust bearing runner 250 to support load in an axial direction of the rotary shaft 212, and casings 220, 240, and 260 to accommodate or receive the drive motor 210, the impeller 230, and the thrust bearing runner 250.

The casings 220, 240, 260 may include a motor casing 220 to accommodate or receive the drive motor 210, an impeller casing 240 to accommodate or receive the impeller 230, and a bearing casing 260 to accommodate or receive the thrust bearing runner 250.

A stator of the drive motor 210 is provided inside the motor casing 220.

The impeller casing 240 constitutes a compressor together with the impeller 230. An inlet flow path 310 to guide inflow of compressing fluid and a discharge flow path 320 to guide the fluid discharged after being compressed by the compressor are each connected to the compressor.

In addition, the turbo compressor 201 may include a cooling flow path 350 branched from the discharge flow path 320 and connected to the bearing casing 260.

A portion of the fluid discharged through the discharge flow path 320 of the turbo compressor 201 is supplied to an inside of the bearing casing 260 to accommodating the thrust bearing runner 250 to cool heat generated at the thrust bearing runner 250.

The turbo compressor 201 includes a drive motor 210, a motor casing 220, an impeller 230 coupled to the rotary shaft 212, an impeller casing 240, a thrust bearing runner 250 coupled to the rotary shaft 212, a bearing casing 260 to accommodate the thrust bearing runner 250, an inflow flow path 310 to guide fluid to an inlet of the impeller casing 240, a discharge flow path 320 to guide the fluid discharged from a discharge outlet of the impeller casing 240, and a cooling flow path 350 to connect the discharge glow path 320 and the bearing casing 260 to supply the fluid to the inside of the bearing casing 260.

This structure may cool the turbo compressor 201 using the compressing fluid without using additional refrigerant or a separate coolant or cooling fluid to cool the turbo compressor 201, thereby removing or not requiring the cooling ring of the related art structure or the inlet and the discharge outlet of the refrigerant connected to the cooling ring. The cooling ring which surrounds an outer circumferential surface of the drive motor may be removed to reduce a size of the turbo compressor.

In addition, the portion of the fluid discharged through the discharge flow path 320 is supplied to the inside of the bearing casing 260 to cool the thrust bearing runner 250.

In this case, a flow rate control means or controller may be provided at the cooling flow path 350 to adjust a flow rate of the fluid supplied into the bearing casing 260 through the cooling flow path 350.

The flow rate control of the fluid supplied through the cooling flow path 350 may be performed by adjusting a cross-sectional area of the cooling flow path 350. In other words, the flow rate of the fluid flowing through the cooling flow path 350 may be adjusted by providing an orifice or a capillary tube in a portion of the cooling flow path 350.

The turbo compressor 201 supplies the portion of the fluid discharged through the discharge flow path 320 into the bearing casing 260.

If an excessive amount of the flow rate of the fluid is supplied through the cooling flow path 350 of the turbo compressor 201, the performance of the compressor is deteriorated.

For this reason, the flow rate of the fluid supplied to the bearing casing 260 through the cooling flow path 350 may be appropriately adjusted.

In addition, the turbo compressor may include a check valve provided in the cooling flow path 350 to prevent backflow of fluid.

Figure 11:
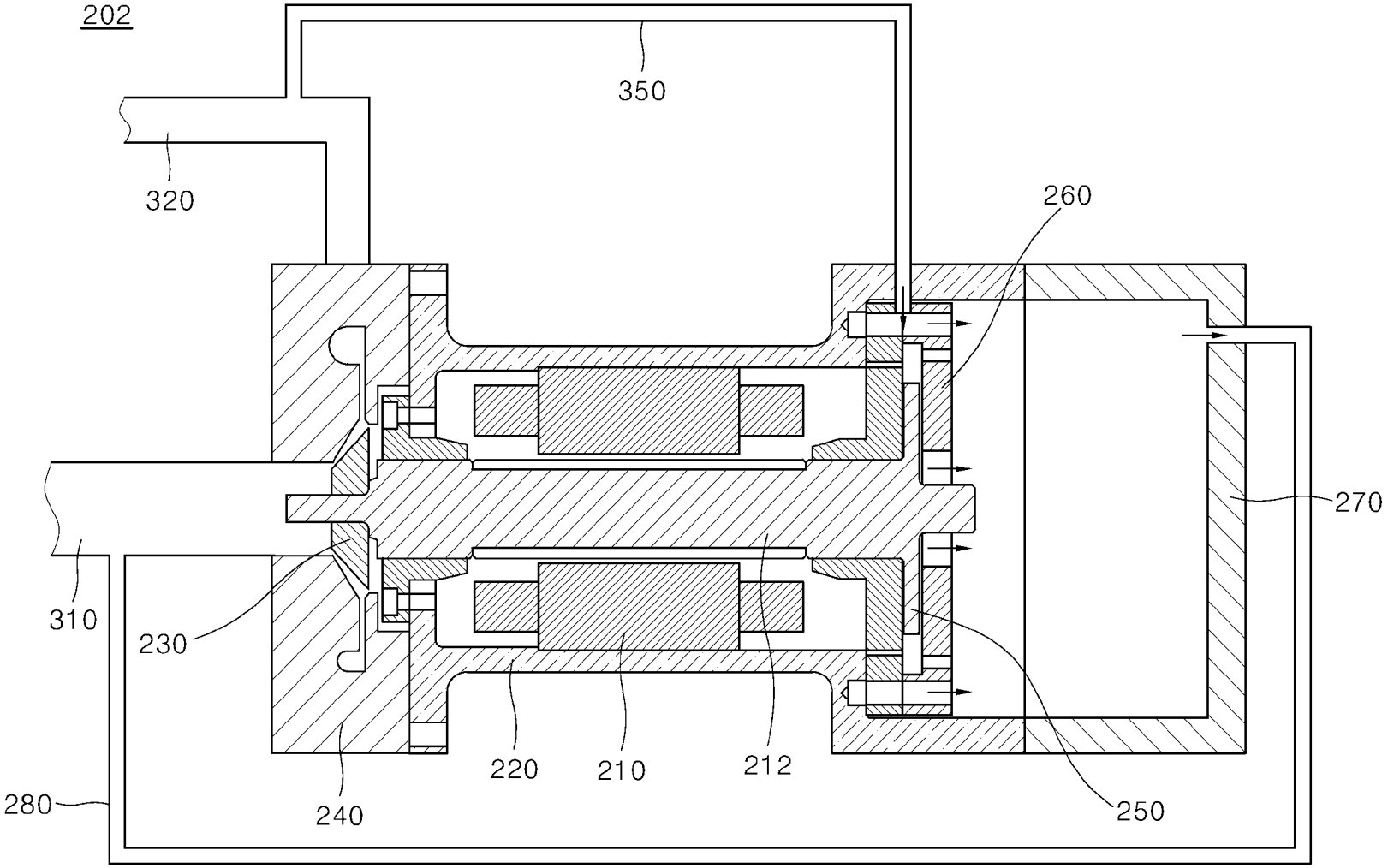
FIG. 11 is a configuration diagram showing a turbo compressor according to a third embodiment of the present disclosure.

FIG. 11 is a configuration diagram showing a structure of a turbo compressor according to a third embodiment of the present disclosure.

Referring to FIG. 11, a turbo compressor 202 according to the third embodiment of the present disclosure includes a drive motor 210, a motor casing 220, an impeller 230, an impeller casing 240, a thrust bearing runner 250, a bearing casing 260, an inlet flow path 310, a discharge flow path 320, and a cooling flow path 350 similar to the second embodiment.

In addition, the turbo compressor 202 according to the third embodiment of the present disclosure further includes a recovery chamber 270 to receive fluid supplied to an inside of the bearing casing 260 through the cooling flow path 350 and a recovery flow path 280 to return the fluid received in the recovery chamber 270 to the compressor.

The recovery chamber 270 functions to supply a space to temporarily store the fluid which is supplied to the inside of the bearing casing 260 through the cooling flow path 350 and stably supply the fluid to the bearing casing 260.

The fluid flows based on a pressure difference. A velocity and the flow rate of the fluid passing through the bearing casing 260 may be set or predetermined based on the pressure difference between the cooling flow path 350 and the recovery chamber 270.

The turbo compressor 202 recovers the fluid used to cool the thrust bearing runner 250 through the recovery chamber 270 and supplies the fluid to the inflow path 310 through the recovery flow path 280, thereby preventing fluid leakage.

The fluid supplied through the discharge flow path 320 has high pressure, but the fluid pressure is decreased as the fluid passes through the inside of the bearing casing 260 and the recovery chamber 270.

In this case, the fluid with the reduced pressure is recovered to the inlet flow path 310 through the recovery flow path 280, and the recovered fluid may be recompressed by the impeller 230.

The turbo compressor 202 according to the present embodiment may further include a flow rate control valve at the recovery flow path 280.

The flow velocity and the flow rate of the fluid supplied to the inside of the bearing casing 260 may be adjusted using the flow rate control valve provided in the recovery flow path 280.

Figure 12:
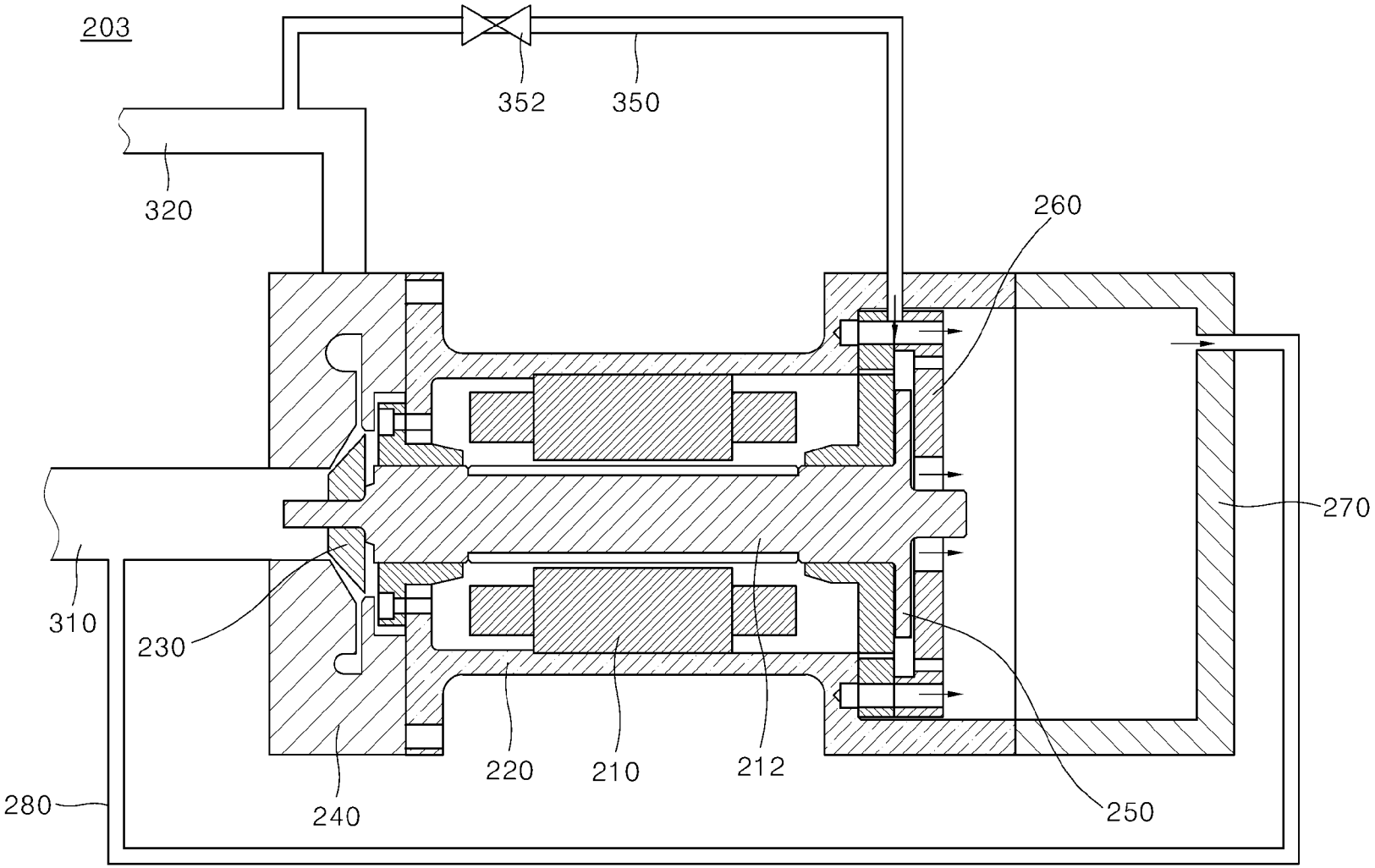
FIG. 12 is a configuration diagram showing a turbo compressor according to a fourth embodiment of the present disclosure.

FIG. 12 is a configuration diagram showing a structure of a turbo compressor according to a fourth embodiment of the present disclosure.

Referring to FIG. 12, a turbo compressor 203 according to the fourth embodiment of the present disclosure includes a drive motor 210 including a rotary shaft 212, a motor casing 220 to accommodate the drive motor 210, an impeller 230 coupled to one side of the rotary shaft 212, an impeller casing 240 to accommodate the impeller 230, a thrust bearing runner 250 coupled to the other side of the rotary shaft 212, a bearing casing 260 to accommodate the thrust bearing runner 250, an inflow flow path 310 to guide fluid to an inlet of the impeller casing 240, a discharge flow path 320 to guide fluid discharged through a discharge outlet of the impeller casing 240, a cooling flow path 350 to connect the discharge flow path 320 and the bearing casing 260 to supply the fluid to an inside of the bearing casing 260, a recovery chamber 270 to receive the fluid supplied to the bearing casing 260, a recovery flow path 280 to guide the fluid received in the recovery chamber 270 to the inlet flow path 310, and a flow rate control valve 352 included in the cooling flow path 350 to adjust flow rate of the fluid flowing through the cooling flow path 350 and to adjust the flow rate of fluid supplied to a bearing.

For example, in the case of low-speed operation in which cooling of the thrust bearing runner 250 is not needed, the flow rate control valve 352 is closed to prevent degradation in compression efficiency, and in the case of high-speed operation, the flow rate control valve 352 is opened to supply the fluid into the bearing casing 260 through the cooling flow path 350.

An opening rate or degree of the flow rate control valve 352 may be adjusted based on a temperature inside the bearing casing 260 or a rotation speed of the drive motor 210.

Figure 13:
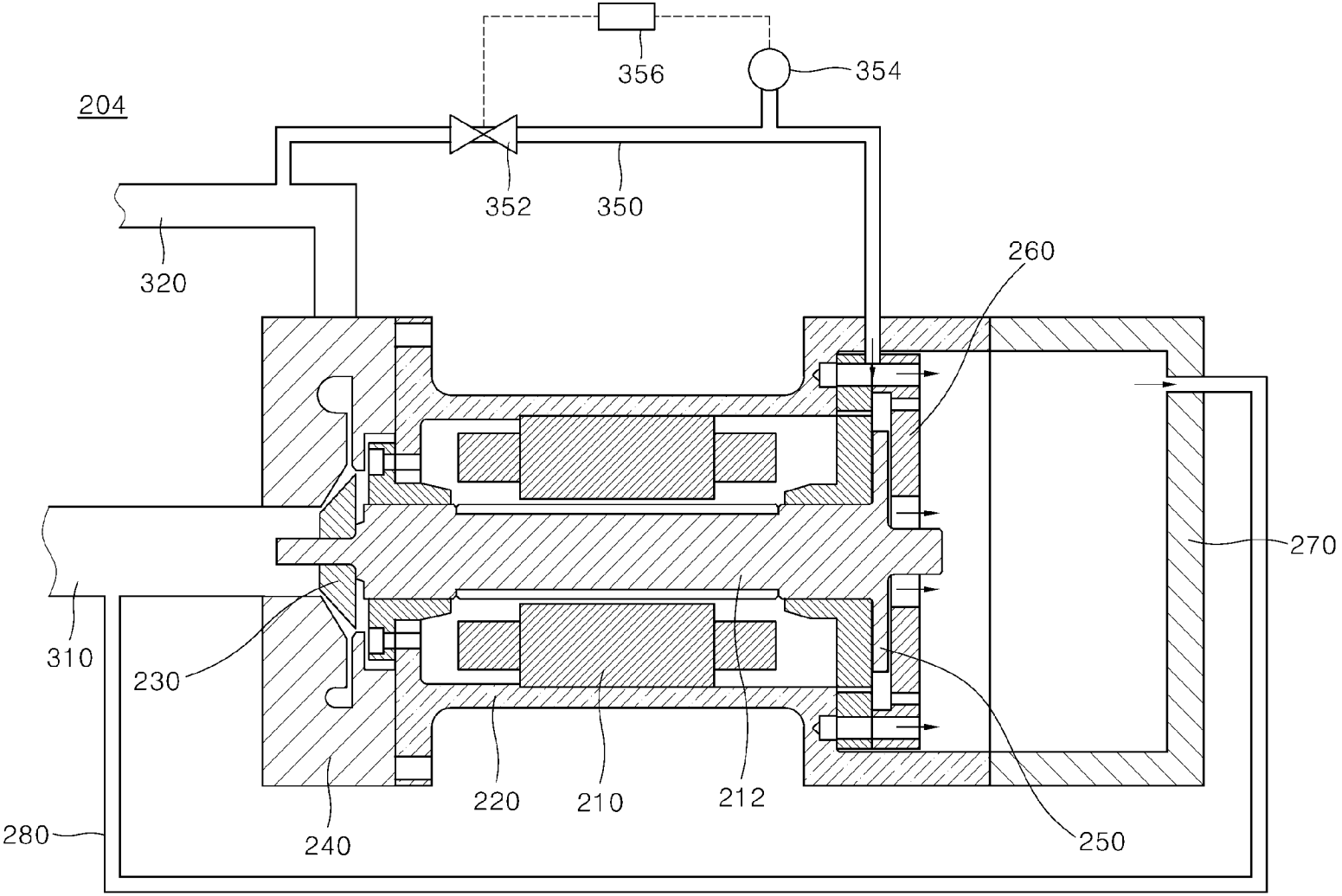
FIG. 13 is a configuration diagram showing a turbo compressor according to a fifth embodiment of the present disclosure.

FIG. 13 is a configuration diagram showing a turbo compressor according to a fifth embodiment of the present disclosure.

Referring to FIG. 13, a turbo compressor 204 according to the fifth embodiment of the present disclosure includes a drive motor 210 including a rotary shaft 212, a motor casing 220 to accommodate the drive motor 210, an impeller 230 coupled to one side of the rotary shaft 212, an impeller casing 240 to accommodate the impeller 230, a thrust bearing runner 250 coupled to the other side of the rotary shaft 212, a bearing casing 260 to accommodate the thrust bearing runner 250, an inlet flow path 310 to guide fluid to an inlet of the impeller casing 240, a discharge flow path 320 to guide the fluid discharged from an outlet of the impeller casing 240, a cooling flow path 350 to connect the discharge flow path 320 and the bearing casing 260 to supply fluid into the bearing casing 260, a recovery chamber 270 to receive the fluid supplied to the bearing casing 260, a recovery flow path 280 to guide the fluid received in the recovery chamber 270 to the inlet flow path 310, a flow rate control valve 352 provided in the cooling flow path 350 to control a flow rate of the fluid flowing through the cooling flow path 350, a pressure sensor 354 provided downstream of the flow rate control valve 352 and to sense pressure of fluid passing through the flow rate control valve 352, and a controller 356 to receive information on pressure detected by the pressure sensor 354 and adjust an opening rate or degree of the flow control valve 352.

The turbo compressor 204 includes the pressure sensor 354 on the downstream side of the flow rate control valve 352 to measure actual pressure of the fluid supplied through the cooling flow path 350 and accurately control the flow rate of the fluid supplied to the bearing casing 260.

Figure 14:
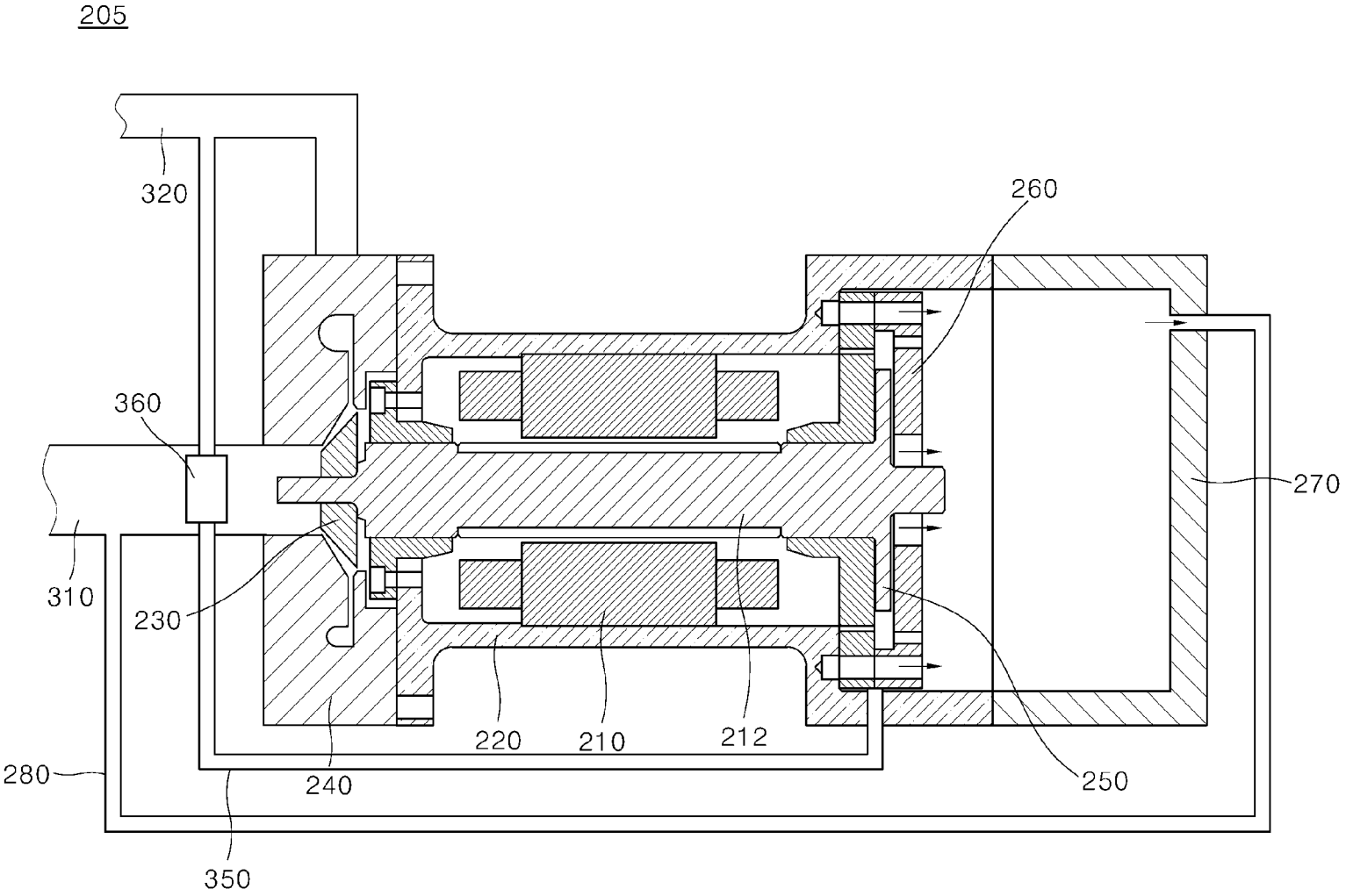
FIG. 14 is a configuration diagram showing a turbo compressor according to a sixth embodiment of the present disclosure.

FIG. 14 is a configuration diagram showing a turbo compressor according to a sixth embodiment of the present disclosure.

Referring to FIG. 14, a turbo compressor 205 according to the sixth embodiment of the present disclosure includes a drive motor 210 including a rotary shaft 212, a motor casing 220 to accommodate the drive motor 210, an impeller 230 coupled to one side of the rotary shaft 212, an impeller casing 240 to accommodate the impeller 230, a thrust bearing runner 250 coupled to the other side of the rotary shaft 212, a bearing casing 260 to accommodate the thrust bearing runner 250, an inlet flow path 310 to guide fluid to an inlet of the impeller casing 240, a discharge flow path 320 to guide fluid discharged from a discharge outlet of the impeller casing 240, a cooling flow path 350 to connect the discharge flow path 320 and the bearing casing 260 to supply fluid into the bearing casing 260, a recovery chamber 270 to receive the fluid supplied to the bearing casing 260, a recovery flow path 280 to guide the fluid received in the recovery chamber 270 to the inlet flow path 310, and a heat exchanger 360 provided along or in the cooling flow path 350 and in the inlet flow path 310.

Relatively high temperature fluid supplied through the cooling flow path 350 may be heat-exchanged with relatively low temperature fluid introduced through the inlet flow path 310 through the heat exchanger 360, thereby reducing a temperature of the fluid supplied through the cooling flow path 350.

The heat exchanger 360 is provided so as not to interfere with a flow of suctioned fluid.

For example, in the case of a pin-tube type heat exchanger, the pin is arranged in parallel with a flow direction of the suctioned fluid.

The fluid supplied through the cooling flow path 350 cools the inside of the bearing casing 260, and the cooling effect is increased as the fluid temperature decreases.

If the cooling effect is improved, the desired cooling effect of the bearing may be obtained with a relatively less flow rate of fluid.

The structure has an effect of eliminating a phenomenon in which cooling is not sufficiently performed when the fluid circulating through a fluid circuit has a relatively high temperature.

Figure 15:
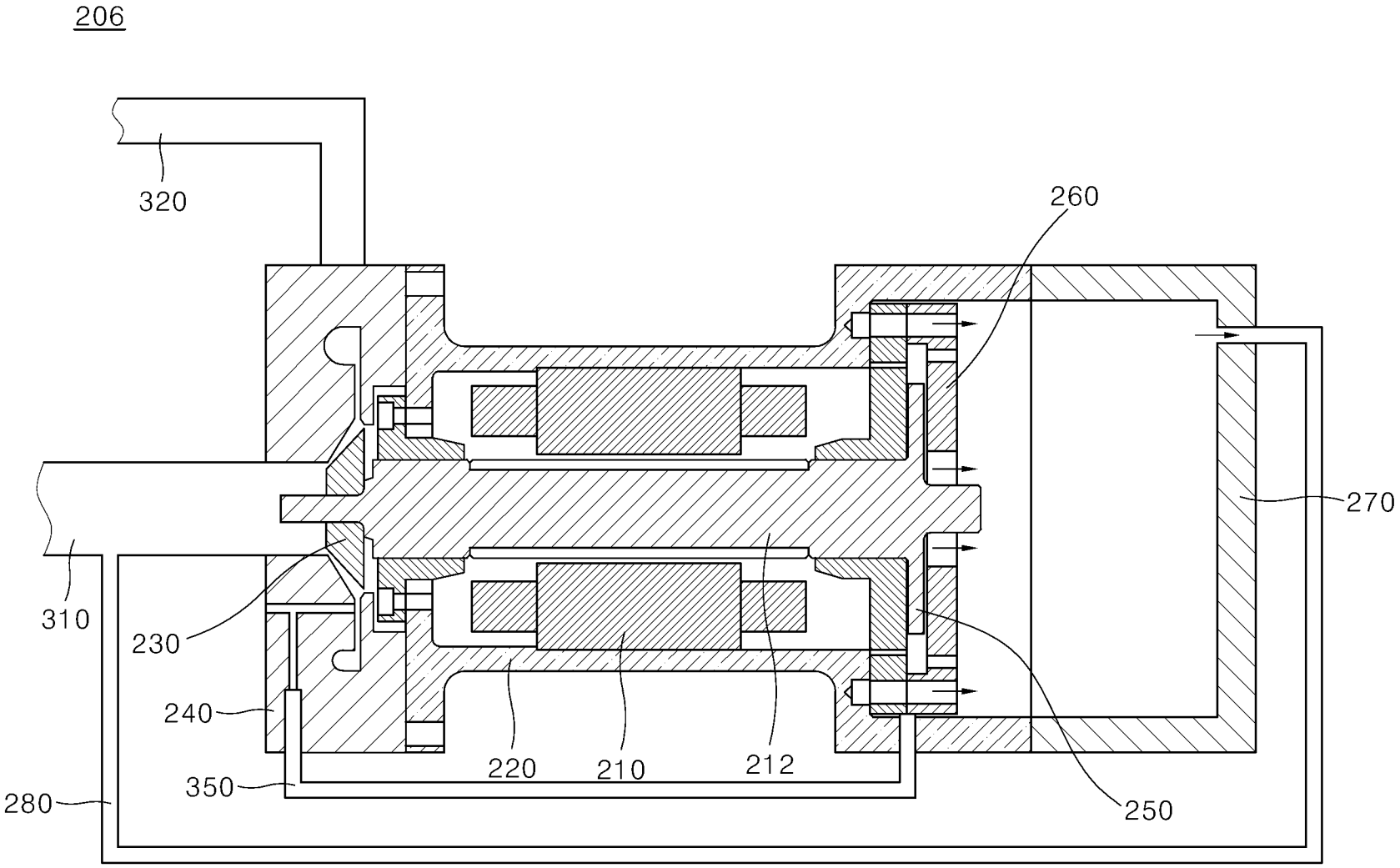
FIG. 15 is a configuration diagram showing a turbo compressor according to a seventh embodiment of the present disclosure.

FIG. 15 is a configuration diagram showing a turbo compressor according to a seventh embodiment of the present disclosure.

Referring to FIG. 15, a turbo compressor 206 according to the seventh embodiment of the present disclosure includes a drive motor 210 including a rotary shaft 212, a motor casing 220 to accommodate the drive motor 210, an impeller 230 coupled to one side of the rotary shaft 212 and rotating together with the rotary shaft 212, an impeller casing 240 to accommodate the impeller 230 and including a diffuser to convert flow of gas accelerated by the impeller 230 into pressure energy, a thrust bearing runner 250 coupled to the other side of the rotary shaft 212 and rotating together with the rotary shaft 212, a bearing casing 260 to support the thrust bearing runner 250, an inlet flow path 310 to guide fluid introduced into the impeller casing 240, a discharge flow path 320 to guide fluid discharged from the impeller casing 240, a cooling flow path 350 connected to the diffuser of the impeller casing 240 and to guide the fluid in the diffuser to the bearing casing 260, a recovery chamber 270 to receive the fluid discharged from the bearing casing 260, and a recovery flow path 280 to guide the fluid received in the recovery chamber 270 to the inlet flow.

The cooling flow path 350 of the turbo compressor 206 is connected to the impeller casing 240 and may not be connected to the discharge flow path 320.

The fluid inside the impeller casing 240 has pressure that is relatively lower than that of the fluid inside the discharge flow path 320, thereby reducing compression loss of the fluid supplied to the cooling flow path 350.

In addition, the configurations of the flow rate control valve 352, the pressure sensor 354, and the controller 356 of the above-described embodiments (e.g., in FIG. 13) may be used.

The invention claimed is:

1. A turbo compressor, comprising:

a rotary shaft comprising a rotor and a groove formed at a first side of the rotary shaft;

a first impeller provided at the first side of the rotary shaft such that a base of the first impeller faces the groove;

a thrust bearing runner provided between the first impeller and the rotary shaft;

a second impeller provided at a second side of the rotary shaft opposite to the first side, the second impeller having a smaller maximum diameter than a maximum diameter of the first impeller; and a tie rod having an outer diameter that is smaller than an inner diameter of the groove, wherein a first end of the tie rod is coupled through the groove to face an inner end of the groove in an axial direction of the rotary shaft and a second end of the tie rod is coupled to a fastening nut, and wherein when the fastening nut is tightened while the thrust bearing runner and the first impeller are inserted between the first side of the rotary shaft and the fastening nut, the tie rod is tensioned, and the first impeller and the thrust bearing runner are compressed and coupled.

2. The turbo compressor of claim 1, further comprising a coupling sleeve provided between the first impeller and the thrust bearing runner.

3. The turbo compressor of claim 2, wherein the first impeller and the thrust bearing runner comprise coupling shafts configured to be inserted into the coupling sleeve so as to couple the first impeller and the thrust bearing runner.

4. The turbo compressor of claim 3, wherein outer diameters of the coupling shafts are equal to or greater than an inner diameter of the coupling sleeve such that the coupling shafts are coupled to the coupling sleeve by press fitting.

5. The turbo compressor of claim 4, wherein a sum of lengths of the coupling shafts inserted into the coupling sleeve is smaller than a length of the coupling sleeve such that the coupling shafts do not contact each other before thea preload is applied.

6. The turbo compressor of claim 1, wherein:

an end of the rotary shaft at the second side comprises a first section, a second section having an outer diameter greater than an outer diameter of the first section, and a stepped surface between the first and second sections;

the second impeller includes a base plate; and the first and second sections are provided inside of and coupled to the second impeller such that the stepped surface contacts the base plate.

7. The turbo compressor of claim 6, wherein a preload is applied to the first and second sections of the rotary shaft by coupling a fastening bolt to the first section of the rotary shaft at a side of the second impeller that is opposite to a side having the base plate.

8. The turbo compressor of claim 1, wherein the rotor is provided at a center of the rotary shaft and protrudes radially outward.

9. The turbo compressor of claim 1, wherein the tie rod is made of a stainless steel material and has a deformation in a range of 7 to 25 μm.

10. The turbo compressor of claim 2, wherein the coupling sleeve has a concavo-convex shape.

11. The turbo compressor of claim 10, wherein the coupling sleeve is made of a labyrinth seal.

12. The turbo compressor of claim 3, wherein the rotary shaft further includes a coupling groove provided at an end of the groove, and wherein an inner diameter of the coupling groove is larger than an inner diameter of the groove.

13. The turbo compressor of claim 12, wherein the thrust bearing runner further includes a shaft that extends opposite to the coupling shaft of the thrust bearing runner, and wherein the shaft is coupled to the coupling groove.

14. The turbo compressor of claim 13, wherein an outer diameter of the shaft of the thrust bearing runner is equal to or larger than the inner diameter of the coupling groove, and wherein the shaft of the thrust bearing runner is inserted into the coupling groove to couple the shaft of thrust bearing runner to the coupling groove of the rotary shaft by press fitting.

15. The turbo compressor of claim 14, wherein a length of the shaft of the thrust bearing runner inserted into the coupling groove is smaller than a depth of the coupling groove such that a compressive force is applied between the thrust bearing runner and the first side of the rotary shaft by a preload applied to the tie rod.

16. A turbo compressor, comprising:

a rotary shaft comprising a rotor;

a first impeller and a second impeller coupled to opposite sides of the rotary shaft and having rear surfaces facing each other so as to have a back-to-back configuration, the first impeller having a larger maximum diameter than a maximum diameter of the second impeller;

a thrust bearing runner coupled to the rear surface of the first impeller; and a tie rod configured to be coupled to the rotary shaft when a preload is applied to the first impeller and the thrust bearing runner, wherein a first end of the tie rod is coupled through a groove formed at a first side of the rotary shaft such that the first end of the tie rod faces an inner end of the groove in an axial direction of the rotary shaft and a second end of the tie rod is coupled to a fastening nut, and wherein when the fastening nut is tightened while the thrust bearing runner and the first impeller are inserted between an end of the first side of the rotary shaft and the fastening nut, the tie rod is tensioned, and the first impeller and the thrust bearing runner are compressed and coupled.

* * * * *